United States Patent [19]

Cochran

[11] Patent Number: 4,818,142

[45] Date of Patent: Apr. 4, 1989

[54] METHOD AND APPARATUS FOR CONSTRUCTING A WALLED POOL EXCAVATION

[76] Inventor: James C. Cochran, Rte. 1, Box 30, Newton, Ala. 36352

[21] Appl. No.: 120,379

[22] Filed: Nov. 13, 1987

[51] Int. Cl.[4] ..... E04H 3/18; B65G 5/00; E04B 1/16

[52] U.S. Cl. ..... 405/55; 4/506; 52/169.7; 52/742; 52/743; 264/31; 249/10; 425/59

[58] Field of Search ..... 405/53, 55; 4/488, 506; 52/169.7, 742, 743; 264/31; 249/10; 425/59

[56] References Cited

U.S. PATENT DOCUMENTS

| | | | |
|---|---|---|---|
| 4,027,442 | 6/1977 | Silverman | 52/169.7 X |
| 4,106,246 | 8/1978 | La Fountaine | 52/169.7 |
| 4,550,538 | 11/1985 | Blakeway | 4/506 X |
| 4,641,465 | 2/1987 | Boyle | 52/169.7 X |
| 4,728,073 | 3/1988 | Smith | 249/10 X |

FOREIGN PATENT DOCUMENTS

| | | | |
|---|---|---|---|
| 689044 | 6/1964 | Canada | 4/506 |
| 2280766 | 2/1976 | France | 52/169.7 |
| 2370842 | 7/1978 | France | 52/169.7 |

*Primary Examiner*—Randolph A. Reese
*Assistant Examiner*—John A. Ricci
*Attorney, Agent, or Firm*—Fleit, Jacobson, Cohn & Price

[57] ABSTRACT

A method and apparatus are provided for forming a cementitious walled ground excavation outwardly of which ground settling is substantially eliminated. A form wall footing is initially erected and leveled upon the bottom of the excavation inward of the walls thereof and inner form walls are then erected upon the outer margin of the footing and anchored in position relative thereto after which an upstanding skeletal reinforcing rod frame is erected between the excavation and form walls and fluent cementitious material is poured about the skeletal framework between the excavation and form walls.

13 Claims, 4 Drawing Sheets

METHOD AND APPARATUS FOR CONSTRUCTING A WALLED POOL EXCAVATION

BACKGROUND OF THE INVENTION

1. Field of the Invention

This invention relates to a method and apparatus by which peripheral walls of considerable strength may be formed within a ground excavation preparatory to lining the bottom of the excavation and the inner surfaces of the walls with a flexible pool liner, the forming of the excavation and the pool peripheral walls being carried out in such a manner to substantially reduce the time and expense required to form the pool walls and further in a manner not requiring the excavation to be backfilled outwardly of the pool walls subsequent to their being formed and enabling substantially all plumbing runs above the bottom of the pool not to be subject to downward pressures thereon by settling ground subsequent to completion of the pool.

2. Description of Related Art

Various different methods and form structures heretofore have been used in the construction of inground pools. Some of these methods and structures have included the use of opposing inner and outer wall forms in order to pour the desired pool walls and also the utilization of only inner wall forms for pouring the desired pool walls between the inner forms and the side walls of the excavation in which the wall forms are erected. However, the popularity of residential pools is increasing the demand therefor as well as competition between pool building contractors.

The method and apparatus of the instant invention enable a pool builder to construct an inground pool in a minimum of time and with a minimum of expense and also in a manner enabling plumbing runs above the bottom of the pool and outwardly of the pool walls to be formed in a manner rendering them substantially non-susceptible to ground settling forces after completion of the pool. Further, the method and apparatus utilized in constructing the walls of the pool further enable the outer peripheral decking of the pool to be poured in a manner which prevents the pool decking from being subject to damage as a result of the ground settling thereunder. Finally, the method and apparatus also enable the pool decking to be poured and substantially all other major structural operations to be carried out in conjunction with construction of the pool prior to the liner being placed within the pool excavation, thereby requiring only through liner wall plumbing connections to be made subsequent to installation of the liner.

SUMMARY OF THE INVENTION

The main object of this invention is to provide a method and apparatus for constructing a walled pool excavation in a minimum amount of time and with a minimum amount of labor.

Another object of this invention is to provide a method and apparatus in accordance with the preceding objects and which will enable pool plumbing runs above the bottom of the pool to be erected in a manner substantially preventing any chance of future damage by ground settling about the plumbing runs.

Still another object of this invention is to provide a method and apparatus which will enable the pool deck to be poured before the liner is installed within the pool excavation.

Another object of this invention is to provide a method and apparatus which will enable the pool deck to be poured in a manner substantially eliminating any possibility of future damage to the pool deck due to settling of the ground thereunder.

Another important object of this invention to be specifically enumerated herein is to provide a method and apparatus in accordance with the preceding objects and which enable the use of only inner form walls during construction of the poured pool walls.

A further object of this invention is to provide a method and apparatus enabling rapid erection of the inner form walls.

A final object of this invention to be specifically enumerated herein is to provide a method and apparatus enabling basically conventional wall pouring operations to be carried out, enabling reinforcing bar frame works to be readily installed and enabling the form walls to be removed while the poured walls are still "green" so as to provide a method which is economically feasible, which may be quickly carried out and which represents a saving in work person hours consumed.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
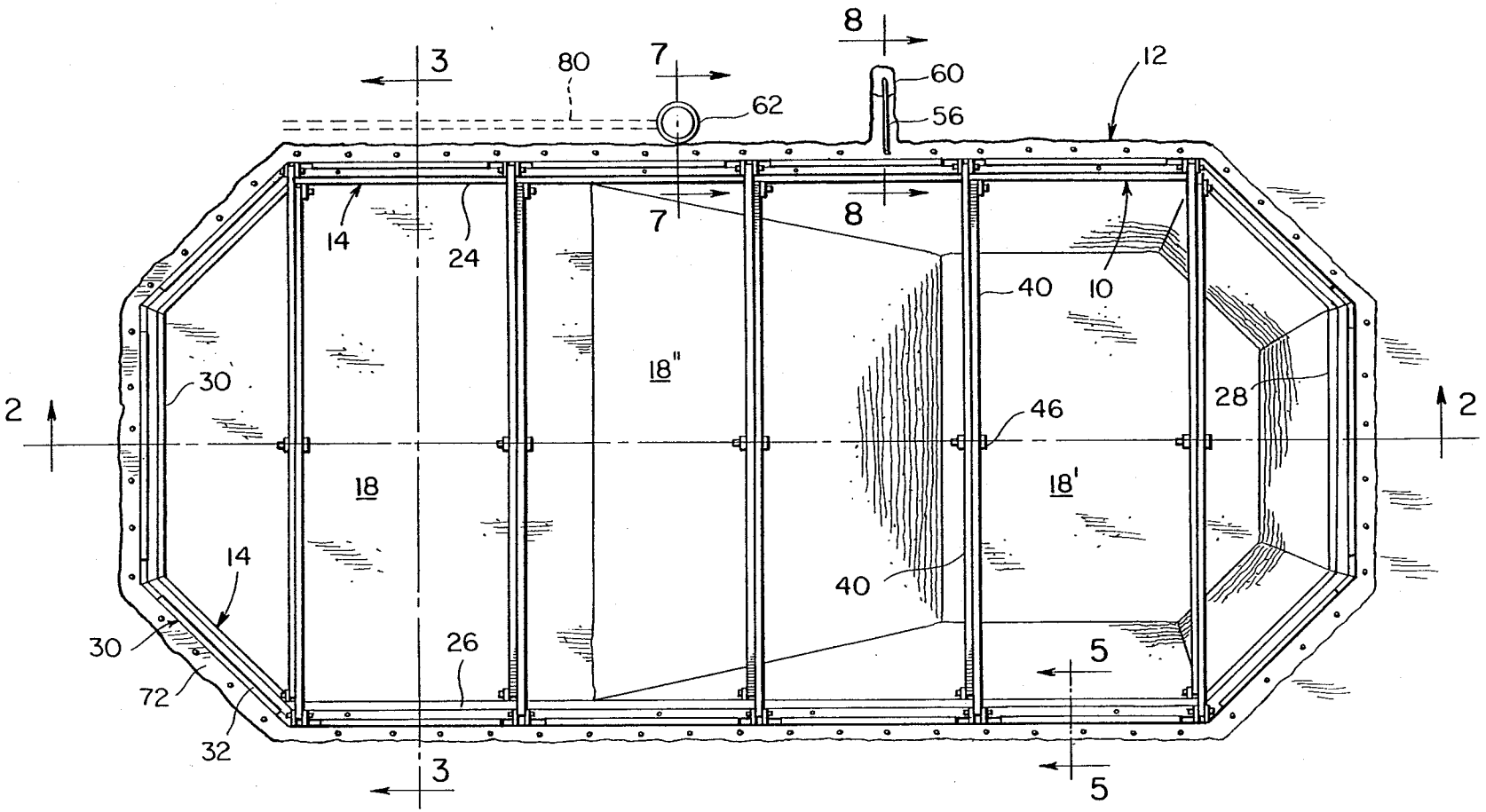
FIG. 1 is a top plan view of a ground excavated area in which inner form walls constructed in accordance with the present invention have been erected.

Referring now more specifically to the drawings, the numeral 10 generally designates an inner form wall construction erected within a ground excavation referred to in general by the reference numeral 12.

The inner form wall construction 10 incorporates a peripheral footing referred to in general by the reference numeral 14 and including end aligned footing sections 16 extending fully about the periphery of the bottom 18 of the excavation 12, adjacent ends of the footing sections 16 being removably joined together in any convenient manner for ready separation. In addition, the footing is leveled fully about the periphery of the bottom 18 and includes an outer margin 20 substantially coinciding with the inner periphery of the poured walls to be formed against the walls 22 of the excavation 12.

As may be seen from FIG. 1 of the drawings, the footing 14 includes two parallel opposite side footing runs 24 and 26 which each may comprise a single or multiple footing sections 16 and a pair of opposite end transverse footing runs 28 and 30 which each also may comprise a single or multiple footing sections 16. If the overall dimensions of the pool to be constructed are not excessive, the footing runs 24, 26, 28 and 30 each may be of one-piece construction to enable the footing 14 to be more easily erected and leveled as well as broken down into its component parts and removed.

Figure 3:
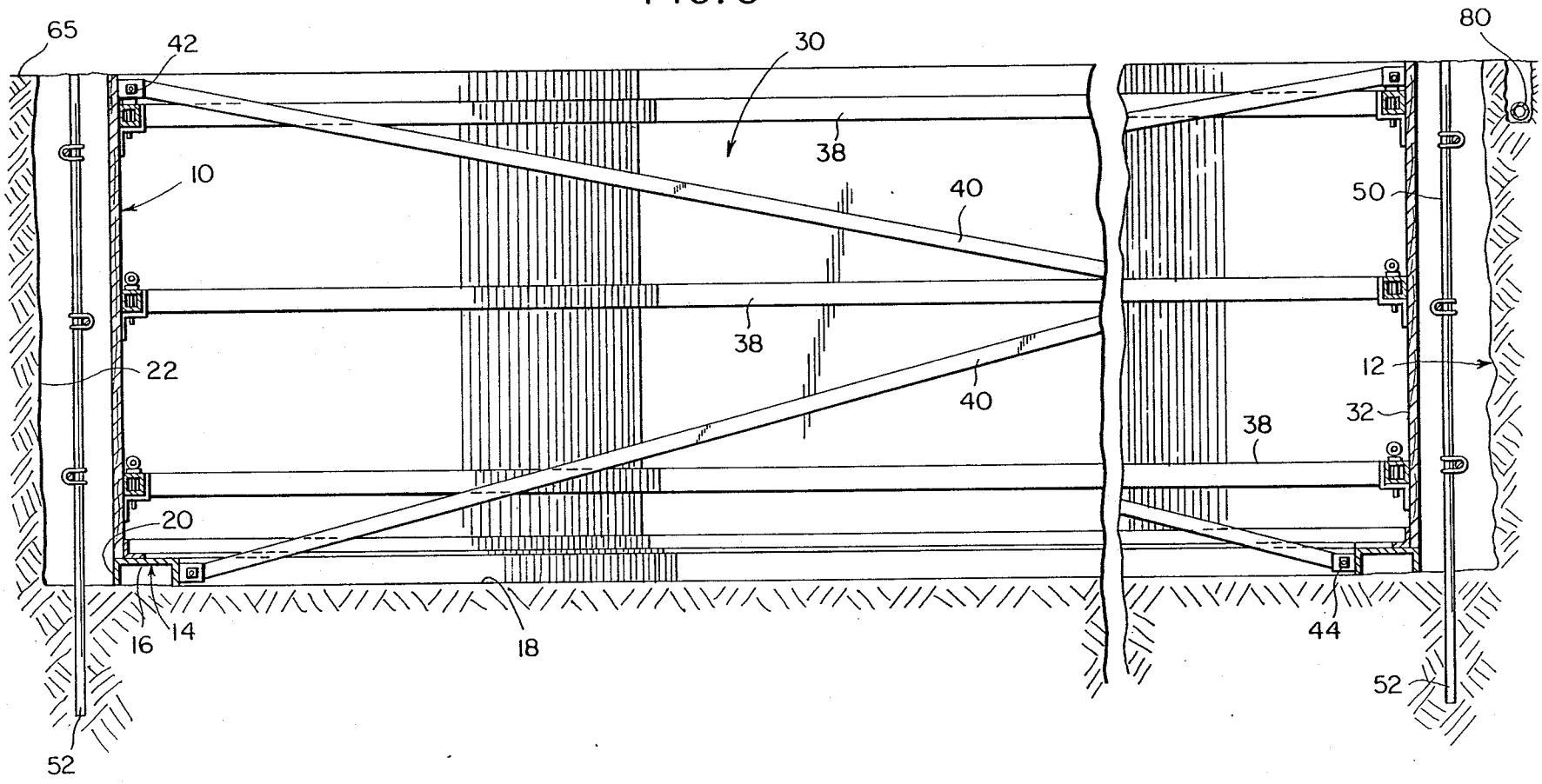
FIG. 3 is an enlarged fragmentary vertical sectional view taken substantially upon the plane indicated by the section line 3—3 of FIG. 1.
Figure 6:
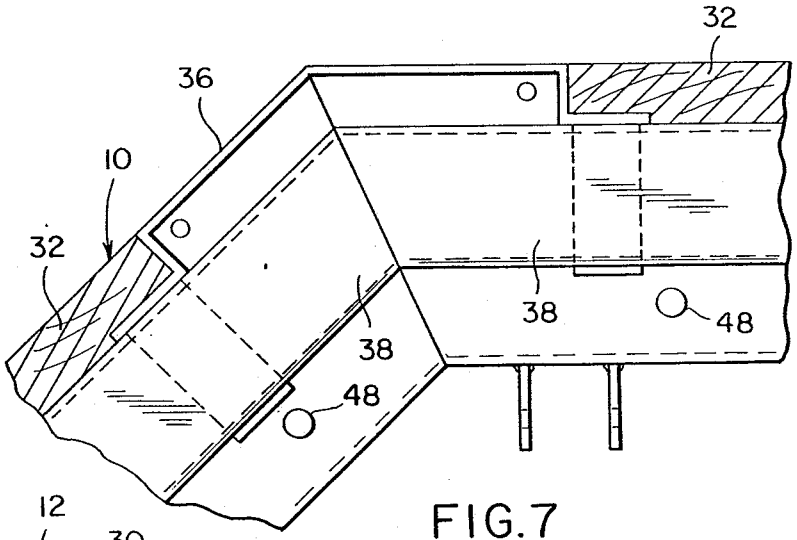
FIG. 6 is a fragmentary enlarged horizontal sectional view similar to FIG. 4 but illustrating the manner in which spaced relatively angulated form walls may be bridged and braced relative other.
Figure 4:
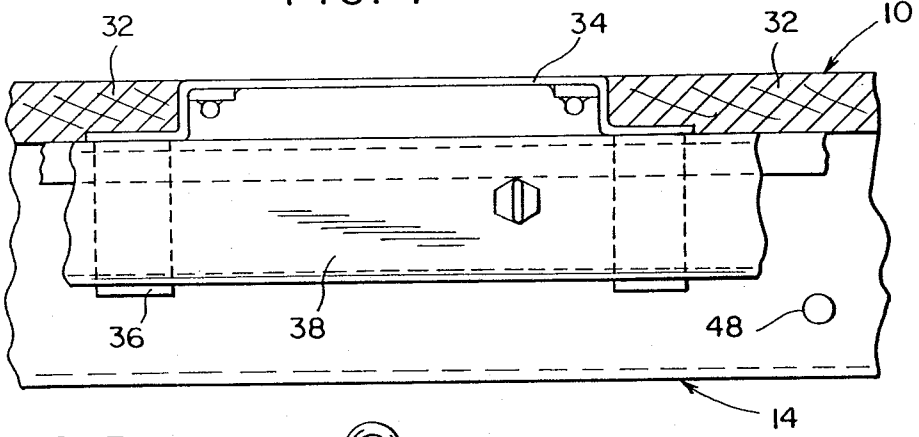
FIG. 4 is an enlarged fragmentary horizontal sectional view illustrating the manner in which horizontally adjacent form wall sections are bridged between and braced relative to each other.

After the footing 14 has been erected, an inner form wall construction referred to in general by the reference numeral 30 extending peripherally about the outer margin 20 of the footing 14 is erected. The construction 30 includes spaced apart form wall panels 32 joined by bridging channel members 34 and 36 (see FIGS. 4 and 6) and the wall panels 32 include vertically spaced sets of horizontally aligned upwardly opening brackets 36 supported from the inner surfaces thereof and in which corresponding vertically spaced horizontal bracing members 38 may be removably secured. In addition, crossed and interconnected braces 40 extend and are interconnected between upper marginal portions of the form wall panels 32 as at 42 and inner marginal portions of the footing 14 as at 44, see FIG. 3. The crossed portions of the braces 40 are removably secured together as at 46 and after the wall construction 30 is erected the footing 14 is secured in place by ground spikes 48, see FIG. 2.

A framework 50 of reinforcing rods is then erected between the wall construction 30 and the excavation wall 22 and anchored relative to the bottom 18 as at 52.

Figure 7:
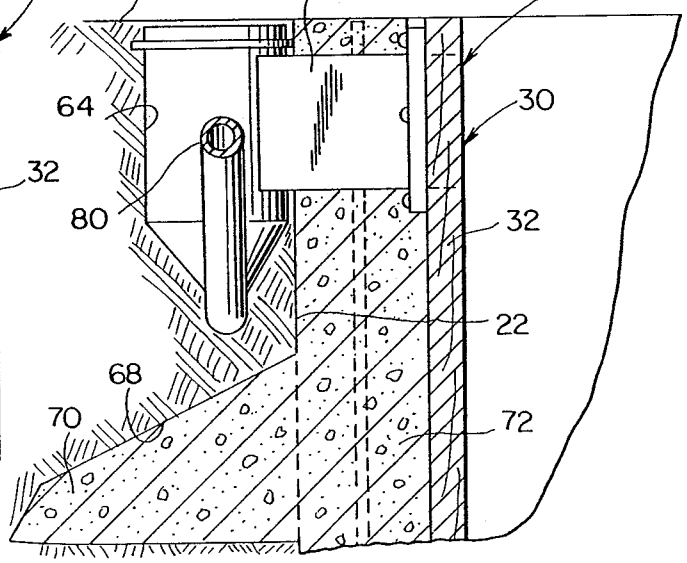
FIG. 7 is an enlarged fragmentary vertical sectional view taken substantially upon the plane indicated by the section line 7—7 of FIG. 1.
Figure 8:
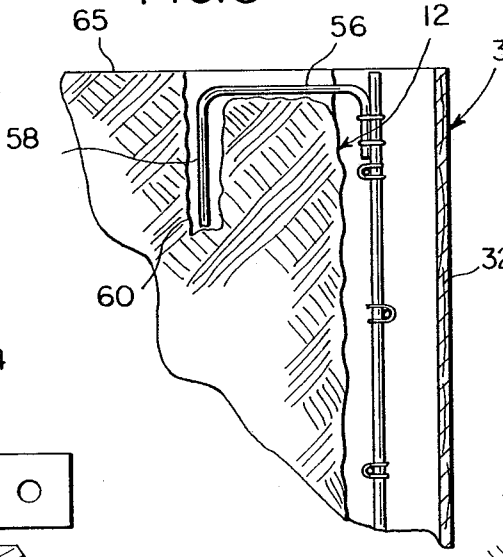
FIG. 8 is an enlarged fragmentary vertical sectional view taken substantially upon the plane indicated by the section line 8—8 of FIG. 1.

Longitudinally spaced portions of the framework 50 may include below ground surface outwardly projecting portions 56 turned downwardly as at 58 and received in corresponding ground recesses 60 spaced outward of the excavation 12. Such portions 56 may be spaced along the periphery of the excavation 12 as desired. Also, suitable through wall plumbing structures 62 may be mounted to outer surfaces of corresponding form wall panels 32 and received in recesses 64 provided therefor in the ground 65 immediately outward of the walls 22 of the excavation 12, see FIG. 7.

Figure 5:
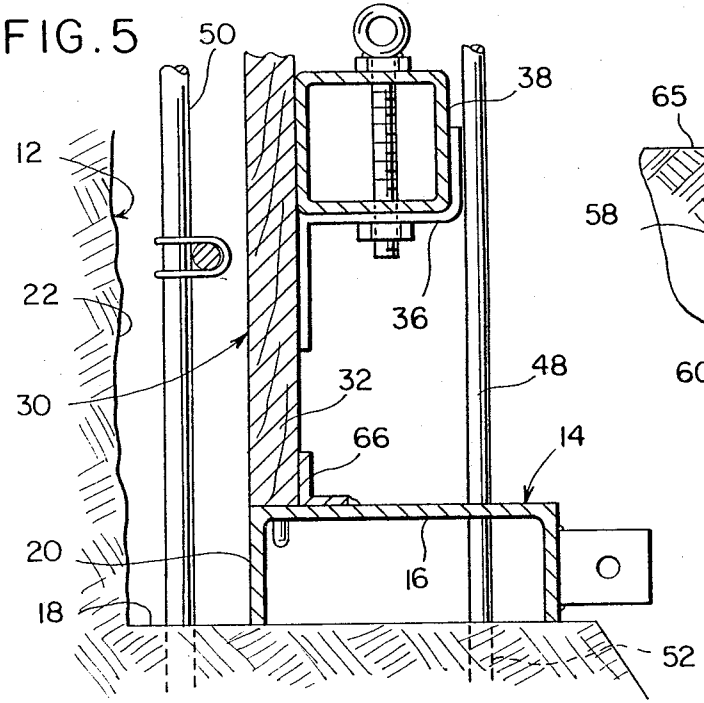
FIG. 5 is an enlarged fragmentary vertical sectional view taken substantially upon the plane indicated by the section line 5—5 of FIG. 1.

It will be noted from FIG. 5 that the footing sections 16 of the footing 14 include angle members 66 supported therefrom and spaced slightly inward of the outer margin 20 of the footing 16. The form wall panels 32 are abutted against the outer surfaces of the angle members 66 and are substantially flush with the outer margin 20 of the footing 14. At this point, the hardenable material (such as concrete) of which the pool walls are to be formed may be poured into the space between the inner form wall construction 30 and the wall 22 of the excavation 12. If desired, inwardly opening recesses 68 may be formed in the wall 22 of the excavation 12 in order that the poured material also may form reinforcing buttresses 70 in such recesses 68.

After the poured material has been hardened at least to some extent in order to form the peripheral wall 72 immediately inwardly of the excavation wall 20, the form wall construction 30 and footing 14 may be removed. Thereafter, a coping or decking may be poured on top of the upper margin of the wall 72 and the upper surface of the ground 65 immediately outward of the wall 72.

Thereafter, the only step remaining to be carried out in order to form the desired pool is to insert a liner (not shown) such as a vinyl liner within the excavation 12 inwardly of the wall 72 and to thereafter form the necessary openings in the liner walls registered with the plumbing structure 62.

Preparatory to digging the excavation 12, the outer boundary of the desired wall 72 is determined and the surface of the ground 65 is leveled and compacted along that outer boundary and outwardly thereof a predetermined distance therefrom. Thereafter, the excavation 12 is formed with the outer peripheral margin of the bottom 18 at least substantially horizontal to facilitate installation and leveling of the footing 14. By compacting the ground 65 immediately outward of the outer boundary of the pool wall to be formed, the excavation 12 including the walls 22 may be formed with reasonable precision in a short period of time and without any of the wall 22 falling into the excavation 12. Thereafter, the footing 14 and wall construction 30 are erected together with the framework 50 and the wall 72 is poured in a reasonable length of time after the excavation 12 has been completed. Of course, before pouring the wall 72, the plumbing structures 62 are positioned as desired.

Then, as hereinabove set forth, after the wall 72 has at least partially cured, the wall construction 30 and footing 14 may be removed and a decking may be poured in position over the upper margin of the wall 72.

Inasmuch as the ground 65 is leveled and compacted prior to forming the excavation 12, there is no need to backfill behind the wall 72 after the latter is formed. Accordingly, the ground immediately outward of the wall 72 will not settle and cause portions of the subsequently poured deck (not shown) to settle. Still further, all horizontal runs of plumbing 80, see FIG. 7, for the plumbing structure 62 may be placed within shallow narrow trenches formed in the ground 65 immediately outward of the wall 72. Accordingly, these plumbing runs have compacted ground disposed immediately thereunder and also are not subject to downward pressure thereon by settling ground after the wall 72 has been poured.

Figure 2:
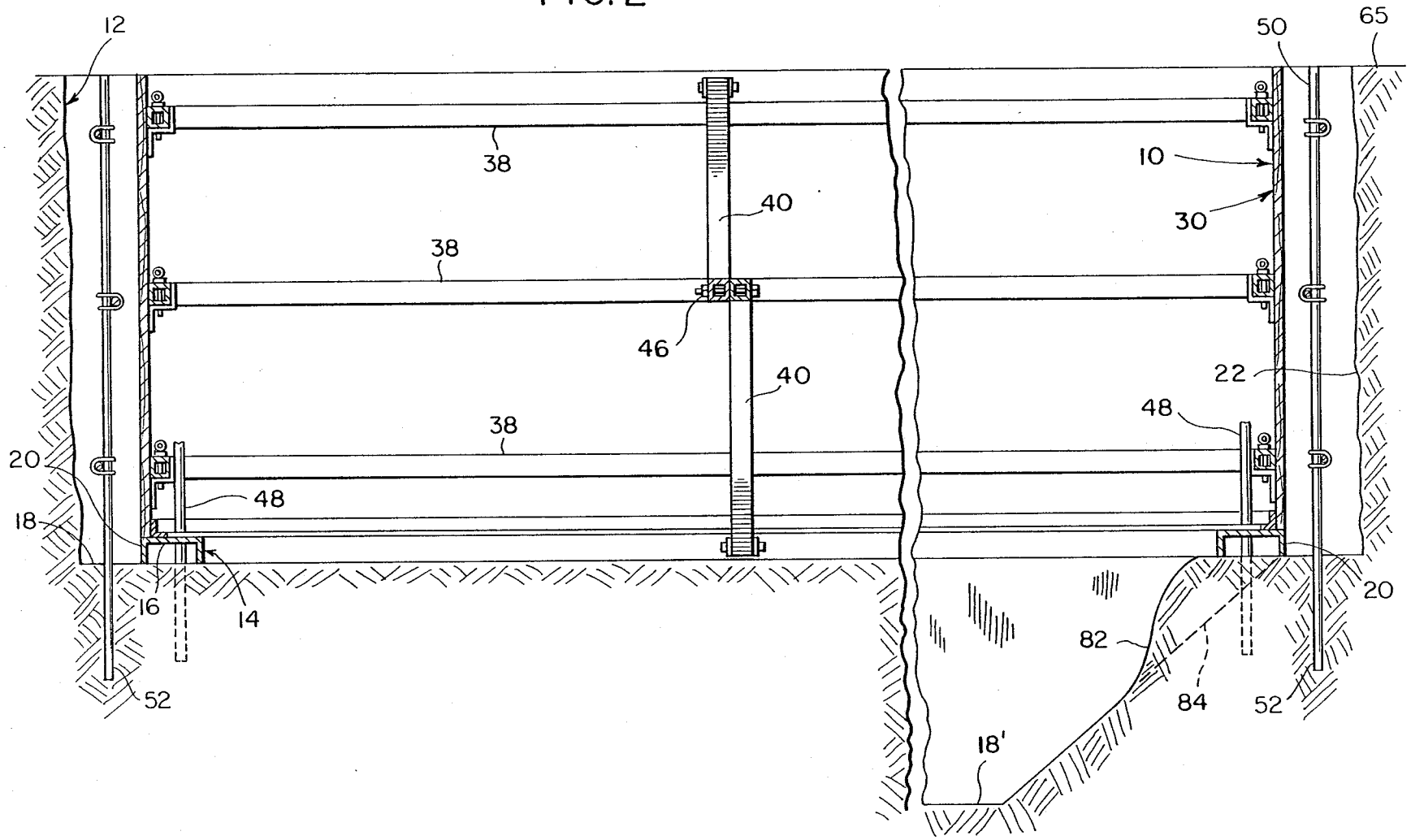
FIG. 2 is an enlarged fragmentary vertical sectional view taken substantially upon the plane indicated by the section line 2—2 of FIG. 1.

With attention now invited more specifically to FIGS. 1 and 5, it may be seen that one end of the bottom 18 of the excavation 12 includes a hopper bottom 18' with an inclined area 18" forming the transition from the bottom 18 to the hopper bottom 18'. In this instance, the transition between the hopper bottom 18' and the level of the bottom 18 is formed along the solid line 82 shown in FIG. 2 and after the wall 72 has been poured and the form wall construction 10 and footing 14 have been removed, the area above the dotted 84 shown in FIG. 2 is removed preparatory to receiving the vinyl liner (not shown) within the boundary defined by the inner surfaces of the wall 72.

The importance of leveling and compacting the ground 65 outward of the outer boundary of the pool wall 72 defined by the outer peripheral area of the excavation 12 to be formed prior to the excavation actually being dug is realized in that there is no need to backfill against the outer side of the wall 72 as is required when outer form wall constructions also are used and there is no need to fill the interior of the pool as such backfilling operations are carried out in order to balance the internal and external pressures on the wall 72. Accordingly, there is no need to install the liner (after the bottom 18 has been covered with a layer of sand or vermiculite and the inner surfaces of the wall 72 has been covered with a layer of foam plastic) within the excavation 12 before a decking is poured and installation of the liner and providing openings therein for the various plumbing structures 62 provided may be carried out in a relatively short period of time and immediately followed by filling the pool and turning operation of the pool over to the owner with only fresh clean water therein as well as an initial charge of chemicals. In this manner, there is no reason for any dirt or other soil to accidentally enter the pool cavity bounded by the wall 72 after the liner has been installed.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. The method of constructing a walled excavation for receiving a vinyl pool liner therein, said method comprising determining the inner and outer boundaries of a pool wall to be formed, leveling and compacting the ground about said boundaries and outwardly from said outer boundary a predetermined minimum distance, excavating the ground within and to said outer boundary, installing and leveling a temporary excavation bottom periphery footer about the periphery of the bottom of said excavation and with said footer including an outer margin at least generally coinciding with the inner boundary of said pool walls, erecting a reinforcing rod skeletal frame about said excavation between said inner and outer boundaries, erecting inner form walls upon and about the outer margin of said footer with cross-bracing extending and removably secured between at least one pair of opposite form walls, pouring hardenable fluent material into said excavation between said inner form walls and the walls of said excavation, allowing said poured material to at least partially harden and thereafter removing said form walls and footer.

2. The method of claim 1 wherein the step of erecting a reinforcing rod skeletal frame about said excavation includes the step of forming longitudinally spaced upper marginal outward extensions of said skeletal frame and with the outer ends of said extensions including downturned terminal ends received in upwardly opening ground cavities for also having said hardenable fluent material poured thereinto.

3. The method of claim 1 wherein the step of erecting cross-bracing between at least one pair of opposite side form walls includes the step of providing oppositely inclined bracing between upper marginal portions of said pair of opposite side form walls and corresponding opposite marginal portions of said footer.

4. The method of claim 3 wherein the step of providing oppositely inclined bracing includes the step of releasably securing longitudinal mid-portions of said oppositely inclined bracing together.

5. The method of claim 1 including the step of securing desired through wall plumbing structures to selected outer surface portions of said form wall during the step of erecting said reinforcing rod skeletal frame.

6. The method of claim 1 wherein the step of erecting inner form walls upon and about the outer margin of said footer includes the step of constructing said form walls through the utilization of individual form wall panels spaced about the periphery of said form wall and removably securing reinforcing members about the inner periphery of said form wall at vertically spaced elevations therealong.

7. The method of claim 1 wherein the step of installing and leveling a temporary excavation bottom periphery footer about the periphery of the bottom of said excavation includes the step of forming an upwardly projecting outwardly facing peripherally continuous abutment surface spaced inwardly of the outer margin of said footer and against which the lower margins of the inner form walls subsequently erected may abut.

8. The method of claim 7 including the step of securing desired through wall plumbing structures to selected outer surface portions of said form wall during the step of erecting said reinforcing rod skeletal frame.

9. The method of claim 8 wherein the step of erecting inner form walls upon and about the outer margin of said footer includes the step of constructing said form walls through the utilization of individual form wall panels spaced about the periphery of said form wall and removably securing reinforcing members about the inner periphery of said form wall at vertically spaced elevations therealong.

10. The method of claim 9 wherein the step of erecting cross-bracing between at least one pair of opposite side form walls includes the step of providing oppositely inclined bracing between upper marginal portions of said pair of opposite side form walls and corresponding opposite marginal portions of said footing.

11. In combination with a ground excavation including vertical walls extending thereabout and projecting above substantially equal depth bottom portions of the excavation spaced slightly inward of the walls thereof, a combined footing and inner form wall assembly including elongated footing sections disposed in substantially end abutted relation and secured together to form an effectively continuous footing extending about the bottom of said excavation spaced slightly inward of the walls thereof and with the footing including an outer periphery, a plurality of form wall panels removably erected upon and about said outer periphery to form a peripherally continuous inner form wall upon said outer periphery, a plurality of cross-bracing members removably secured between and relatively bracing at least one pair of opposite form wall panels, a plurality of vertically spaced and effectively peripherally continuous bracing members secured about said form wall assembly inwardly of the latter, and an upstanding effectively peripherally continuous reinforcing rod frame erected between said form wall assembly and the opposing walls of said excavation.

12. The combined footing and form wall assembly of claim 11 wherein said form wall panels include lower marginal portions resting upon said footing sections and said footing sections and lower marginal portions include coacting means preventing inward displacement of said lower marginal portions relative to said footing sections.

13. The combined ground excavation, footing and inner form wall assembly of claim 11 including means anchoring longitudinally spaced portions of said footing to the ground thereunder.

* * * * *